US008883306B2

(12) United States Patent
Del Río Rodriguez et al.

(10) Patent No.: US 8,883,306 B2
(45) Date of Patent: Nov. 11, 2014

(54) COLD DRAWN LOW CARBON STEEL FILAMENT AND METHOD OF MANUFACTURING SAID FILAMENT

(75) Inventors: Javier Del Río Rodriguez, Lille (FR); Dirk Meersschaut, Ooigem (BE)

(73) Assignee: NV Bekaert SA, Zwevegem (BE)

( * ) Notice: Subject to any disclaimer, the term of this patent is extended or adjusted under 35 U.S.C. 154(b) by 645 days.

(21) Appl. No.: 12/920,711

(22) PCT Filed: Feb. 25, 2009

(86) PCT No.: PCT/EP2009/052216

§ 371 (c)(1),
(2), (4) Date: Sep. 2, 2010

(87) PCT Pub. No.: WO2009/109495

PCT Pub. Date: Sep. 11, 2009

(65) Prior Publication Data

US 2011/0000593 A1 Jan. 6, 2011

(30) Foreign Application Priority Data

Mar. 4, 2008 (EP) ..... 08152265

(51) Int. Cl.

| | |
|---|---|
| ***B32B 15/00*** | (2006.01) |
| ***D02G 3/00*** | (2006.01) |
| ***B21C 1/00*** | (2006.01) |
| ***B60C 9/00*** | (2006.01) |
| ***D02G 3/48*** | (2006.01) |
| ***D04H 3/00*** | (2012.01) |
| ***D07B 1/06*** | (2006.01) |
| ***C21D 8/06*** | (2006.01) |
| ***C21D 9/52*** | (2006.01) |
| ***C21D 7/02*** | (2006.01) |

(52) U.S. Cl.

CPC ..... *C21D 9/525* (2013.01); *D07B 2201/2011* (2013.01); *D07B 2201/2013* (2013.01); *D07B 1/066* (2013.01); *D07B 2205/3089* (2013.01); *D07B 2205/3042* (2013.01); *D07B 2205/3064* (2013.01); *D07B 2205/305* (2013.01); *D07B 1/0666* (2013.01); *D07B 2205/3067* (2013.01); *D07B 2205/3071* (2013.01); *C21D 8/06* (2013.01); *D07B 2205/3035* (2013.01); *C21D 7/02* (2013.01)

USPC ..... 428/379; 428/357; 428/364; 428/391; 428/401; 428/292.1; 428/297.4; 428/300.1; 428/222; 428/295.1; 428/296.4; 152/151; 152/451; 72/274

(58) Field of Classification Search

USPC ..... 428/222, 295.1, 296.4, 292.4, 300.1, 428/357, 364, 679, 391, 401; 152/151, 451; 73/274

See application file for complete search history.

(56) References Cited

U.S. PATENT DOCUMENTS

| | | | | | |
|---|---|---|---|---|---|
| 3,502,513 | A | * | 3/1970 | Rice et al. | 148/596 |
| 4,255,496 | A | * | 3/1981 | Haemers | 428/677 |
| 4,613,385 | A | * | 9/1986 | Thomas et al. | 148/599 |
| 5,141,570 | A | * | 8/1992 | Yutori et al. | 148/320 |
| 5,833,771 | A | | 11/1998 | Arnaud et al. | |
| 5,843,583 | A | | 12/1998 | D'Haene et al. | |
| 2005/0079364 | A1 | * | 4/2005 | van Ooij et al. | 428/447 |
| 2008/0041503 | A1 | | 2/2008 | Torizuka et al. | |

FOREIGN PATENT DOCUMENTS

| | | | | |
|---|---|---|---|---|
| JP | 5-105951 | A | | 4/1993 |
| JP | 2003321742 | A | * | 11/2003 |
| WO | WO 84/02354 | A1 | | 12/1982 |

* cited by examiner

*Primary Examiner* — Jennifer Chriss
*Assistant Examiner* — Frank Vineis
(74) *Attorney, Agent, or Firm* — Foley & Lardner LLP

(57) ABSTRACT

A steel filament adapted for the reinforcement of elastomer or for thermoplastic products has a carbon content ranging up to 0.20 per cent by weight. The steel filament is provided with a coating promoting the adhesion with elastomer or thermoplastic products. The steel filament is drawn until a final diameter of less than 0.60 mm and a final tensile strength of more than 1200 MPa. Intermediate heat treatments are avoided so that the carbon footprint of the steel filament is substantially reduced.

14 Claims, No Drawings

COLD DRAWN LOW CARBON STEEL FILAMENT AND METHOD OF MANUFACTURING SAID FILAMENT

TECHNICAL FIELD

The present invention relates to a steel filament and to a steel cord adapted for the reinforcement of elastomer products or of thermoplastic products.

The present invention also relates to a method of manufacturing such a steel filament and such a steel cord.

BACKGROUND ART

Steel filaments and steel cords adapted for the reinforcement of elastomer products such as tires, impact beams, hoses, flexible pipes, . . . are well known in the prior art.

Steel filaments and steel cords are made starting from steel wire rod. This steel wire rod typically has a steel composition along following lines. A carbon content of more than 0.60 per cent by weight, a manganese content ranging between 0.40 per cent and 0.70 per cent by weight, a silicon content ranging between 0.15 per cent and 0.30 per cent by weight, a maximum sulphur and a maximum phosphorus content of 0.03 per cent by weight. Other micro-alloying elements may be added. An example is chromium. The steel wire rod usually has a diameter $d_S$ of 5.5 mm or of 6.5 mm.

The wire rod is firstly cleaned by mechanical descaling and/or by chemical pickling in a $H_2SO_4$ or HCl solution in order to remove the oxides present on the surface. The wire rod is then rinsed in water and is dried. The dried wire rod is then subjected to a first series of dry drawing operations in order to reduce the diameter until a first intermediate diameter.

At this first intermediate diameter d1, e.g. at about 3.0 to 3.5 mm, the dry drawn steel wire is subjected to a first intermediate heat treatment, called patenting. Patenting means first austenitizing until a temperature of about 1000° C. followed by a transformation phase from austenite to pearlite at a temperature of about 600-650° C. The steel wire is then ready for further mechanical deformation.

Thereafter the steel wire is further dry drawn from the first intermediate diameter $d_1$ until a second intermediate diameter $d_2$ in a second number of diameter reduction steps. The second diameter $d_2$ typically ranges from 1.0 mm to 2.5 mm.

At this second intermediate diameter $d_2$, the steel wire is subjected to a second patenting treatment, i.e. austenitizing again at a temperature of about 1000° C. and thereafter quenching at a temperature of 600 to 650° C. to allow for transformation to pearlite.

If the total reduction in the first and 2nd dry drawing step is not too big a direct drawing operation can be done from wire rod till diameter $d_2$.

After this second patenting treatment the steel wire is usually provided with a brass coating: copper is plated on the steel wire and zinc is plated on the copper. A thermo diffusion treatment is applied to form the brass coating.

The brass-coated steel wire is then subjected to a final series of cross-section reductions by means of wet drawing machines. The final product is a high-tensile steel filament with a carbon content above 0.60 per cent by weight, with a tensile strength above 2000 MPa and adapted for the reinforcement of elastomer products.

Despite its wide-spread use, the above described process has a disadvantage it that it consumes a lot of energy. More particularly, the double patenting process steps and their related austenitizing furnaces require a lot of energy. As a matter of example only, a single austenitizing furnace produces a power of 374 KWatt/Ton of produced steel cord. Indeed the furnaces and the associated quenching process represent a considerable part of the $CO_2$ production during the manufacturing of steel filaments and steel cords adapted for the reinforcement of elastomer products. The patenting process, however, is needed and cannot be cancelled as such. This patenting process restores the metal structure of the steel wire into a state which allows for further drawing. Without this patenting process the steel wires would break frequently during further drawing and would become too brittle.

DISCLOSURE OF INVENTION

It is an object of the present invention to avoid the drawbacks of the prior art.

It is also an object of the present invention to provide a steel filament with a production process which costs less energy.

It is another object of the present invention to avoid the use of austenitizing furnaces and of other intermediate heat treatments.

According to a first aspect of the present invention, there is provided a steel filament adapted for the reinforcement of elastomer products. The steel filament has a plain carbon composition. A plain carbon composition is a steel composition where—possibly with exception for silicon and manganese—all the elements have a content of less than 0.50 per cent by weight, e.g. less than 0.20 per cent by weight, e.g. less than 0.10 per cent by weight. Silicon is present in amounts of maximum 1.0 per cent by weight, e.g. maximum 0.50 per cent by weight, e.g. 0.30 wt % or 0.15 wt %. Manganese is present in amount of maximum 2.0 per cent by weight, e.g. maximum 1.0 per cent by weight, e.g. 0.50 wt % or 0.30 wt %.

In the present invention, the carbon content ranges up to 0.20 per cent by weight, e.g. up to 0.10 per cent by weight, e.g. ranging up to 0.06 per cent by weight. The minimum carbon content can be about 0.02 per cent by weight.

The plain carbon composition has mainly a ferrite or pearlite matrix and is mainly single phase. There are no martensite phases, bainite phases or cementite phases in the ferrite or pearlite matrix.

The steel filament is provided with a coating promoting the adhesion with elastomer products, such as zinc or brass. The steel filament is drawn until a final diameter of less than 0.60 mm and has a final tensile strength of more than 1200 MPa.

The drawing of this low-carbon steel filament can be done without the intermediate patenting process and without any other heat treatment such as annealing because of the low carbon content.

The steel filament is directly drawn from wire rod of e.g. 5.5 mm diameter until a filament diameter of lower than 0.60 mm, resulting in a reduction in cross-sectional area of more than 98 per cent. With a final diameter equal to or lower than 0.45 mm, a reduction in cross-sectional area of more than 99 per cent has been realized.

Coating of e.g. brass can be done at an intermediate wire diameter between 5.5 mm and 0.60 mm. The brass coated steel wire is then further drawn, again without intermediate heat treatments, until its final filament diameter. The brass coating has a double function. First of all, in the final product, the brass promotes the adhesion with rubber by making sulphur bridges between the copper in the brass and the rubber. In the second place, brass being is a softer material than the low carbon steel, brass functions as a lubricant during the final drawing stages and allows the steel filament to be subjected to the above-mentioned high degrees of reduction in cross-sectional area. Due to this high deformability, high levels of final tensile strengths are obtainable.

Prior art document JP-A-05/105951 discloses a low carbon steel wire. This low carbon steel wire is, however, subjected to one or more intermediate heat treatments.

Prior art document U.S. Pat. No. 5,833,771 discloses a steel wire with a low carbon content for the reinforcement of tires. However, the steel wire has a stainless steel composition with, amongst other elements, e.g. between 6 and 10% nickel and between 16% and 20% chromium. This is not a plain carbon composition.

Prior art document WO-A-84/02354 discloses a high strength, low carbon steel rod and steel wire. However, this steel wire has a dual-phase steel composition with a ferrite matrix with a dispersed second phase such as martensite, bainite and/or austenite. This dual phase steel is different from a plain carbon steel.

According to a second aspect of the present invention, there is provided a steel cord having one or more low-carbon steel filaments according to the first aspect of the present invention.

Preferably, the steel cord consists of only low-carbon steel filaments according to the first aspect of the invention.

Examples of suitable steel cord constructions are all steel cord constructions which are suitable for the reinforcement of the breaker or belt layer of tires: 2×1, 3×1, 4×1, 5×1, 1+4, 1+5, 1+6, 2+2, 3+2, 2+3.

According to a third aspect of the present invention, there is provided a method for manufacturing a steel filament adapted for the reinforcement of elastomer products. The method comprises the following steps:

a. providing a steel wire rod having a carbon content up to 0.08 per cent by weight;
b. drawing this steel wire rod directly to a final diameter smaller than 0.60 mm and up to a tensile strength higher than 1200 MPa thereby avoiding any intermediate heat treatments such as patenting;
c. providing this steel filament with a coating promoting the adhesion with elastomer products.

The coating can be provided at final filament diameter or, preferably, at an intermediate diameter, as has been explained here above.

These process steps a. to c. may be followed by a process step of twisting various such low carbon filaments with each other or with other filaments to form a steel cord.

By avoiding the intermediate heat treatments up to more than 3% savings could be made in $CO_2$ production in comparison with the prior art situation.

According to a fourth aspect of the present invention, the low-carbon steel filaments according to the first aspect of the invention or the low-carbon steel cords according to the second aspect of the invention, are used in an elastomer or thermoplastic product.

Suitable elastomer products are tires, conveyor belts, timing belts, hoses, flexible pipes, etc. Suitable thermoplastic products are impact beams and flexible hoses.

The invention steel filament (first aspect) and the invention steel cord (second aspect) are particularly suitable for the reinforcement of the breaker or belt layer of a tire. Although lacking tensile strengths above 2000 MPa, the low carbon filaments and low carbon steel cords according to the invention provide the breaker or belt layer of a tire the required degree of stiffness.

MODE(S) FOR CARRYING OUT THE INVENTION

A steel cord according to the invention can be made as follows.

Starting product is a wire rod with a plain carbon composition with a carbon content ranging between 0.04 wt % and 0.08 wt %. The complete composition of the wire rod is as follows: a carbon content of 0.06 wt %, a silicon content of 0.166 wt %, a chromium content of 0.042 wt %, a copper content of 0.173 wt %, a manganese content of 0.382 wt %, a molybdenum content of 0.013 wt %, a nitrogen content of 0.006 wt %, a nickel content of 0.077 wt %, a phosphorus content of 0.007 wt %, a sulphur content of 0.013 wt %.

Generally, as mentioned the silicon content is below 1.0 wt %, the manganese content below 2.0%. Furthermore, the amounts of Cr, Cu, Ni and Mo are limited to 0.20%. The amounts of phosphorus and sulphur are limited to 0.030 wt %. The amount of N is limited to 0.015%.

The wire rod is dry drawn from the wire rod diameter of 5.5 mm until an intermediate diameter of 2.0 mm.

At this intermediate diameter of 2.0 mm, copper is first electroplated on the steel wire e.g. in a Cu-pyrophosphate bath, then zinc is electroplated on the steel wire e.g. in a $ZnSO_4$ bath, and thereafter a thermodiffusion treatment is applied in order to provide a brass coating on the wire.

The thermodiffusion involves heating up to a temperature of 450° C. to 600° C. This treatment, however, only lasts a few seconds. This temperature is not as elevated as the austhenitizing temperature. Moreover, the thermodiffusion does not realize a change in metal structure of the steel wire.

No patenting takes place at this intermediate diameter. Similarly, no other heating treatment such as annealing takes place at this intermediate diameter.

As an alternative to brass, the steel wire can be electroplated with zinc.

Coming back to the brass coating, the brass coated steel wire of 2.0 mm is then wet drawn until a final filament with a final diameter of 0.45 mm of 1400 MPa.

Finally, several such low-carbon 0.45 filaments are twisted into a 1+5×0.45 steel cord. This low-carbon steel cord has a breaking load of 1270 Newton.

Other examples of an invention cord are:

3+2×0.45

1+4×0.45

In case the steel wire has been electroplated with zinc, a silane primer can be applied to the twisted steel cord in the following way. After an optional cleaning operation, the steel cord may be coated with a primer selected from organo functional silanes, organo functional titanates and organo functional zirconates which are known in the art for said purpose. Preferably, but not exclusively, the organo functional silane primers are selected from the compounds of the following formula:

$$Y—(CH_2)_n—SiX_3$$

wherein:

Y represents an organo functional group selected from $—NH_2$, $CH_2{=}CH—$, $CH_2{=}C(CH_3)COO—$, 2,3-epoxypropoxy, HS— and, Cl—

X represents a silicon functional group selected from —OR, —OC(=O)R', —Cl wherein R and R' are independently selected from $C_1$ to $C_4$ alkyl, preferably $—CH_3$, and $—C_2H_5$; and n is an integer between 0 and 10, preferably from 0 to 10 and most preferably from 0 to 3.

The organo functional silanes described above are commercially available products.

By applying the process according to the invention, a saving of 70 kg $CO_2$ per Ton of steel cord has been realized. As a result the carbon footprint of the invention steel cord has decreased in comparison with prior art steel cords.

The invention claimed is:

1. A steel filament adapted for the reinforcement of elastomer products, said steel filament consisting of iron, a plain carbon composition with a carbon content ranging up to 0.20 percent by weight, a silicon content below 1.0 percent by weight, a manganese content below 2.0 percent by weight, amounts of chromium, copper, nickel, and molybdenum are limited to 0.20 percent by weight, amounts of phosphorus and sulfur are limited to 0.030 percent by weight, and a nitrogen content is limited to 0.015 percent by weight, said plain carbon composition having mainly a ferrite or pearlite matrix, wherein there are no martensite phases or bainite phases, said steel filament being provided with a coating promoting the adhesion with elastomer products or with thermoplastic products, said steel filament being cold drawn until a final diameter of less than 0.60 mm, said steel filament having a final tensile strength of more than 1200 MPa.

2. A steel filament according to claim 1, wherein said steel filament has a minimum carbon content of 0.02 percent by weight.

3. A steel filament according to claim 1, said filament having undergone a reduction in cross-section area of more than 98 percent.

4. A steel cord adapted for the reinforcement of elastomer products, said steel cord comprising one or more steel filaments according to claim 1.

5. A steel cord according to claim 4, said steel cord having a construction belonging to the group consisting of 2×1, 3×1, 4×1, 5×1, 1+4, 1+5, 1+6, 2+2, 3+2, and 2+3.

6. A method for manufacturing a steel filament adapted for the reinforcement of elastomer products, said method comprising the following steps:

a. providing a steel wire rod consisting of iron, a plain carbon composition comprising a carbon content up to 0.20 percent by weight, a silicon content below 1.0 percent by weight, a manganese content below 2.0 percent by weight, amounts of chromium, copper, nickel, and molybdenum are limited to 0.20 percent by weight, amounts of phosphorus and sulfur are limited to 0.030 percent by weight, and a nitrogen content is limited to 0.015 percent by weight, said plain carbon composition having mainly a ferrite or pearlite matrix, wherein there are no martensite phases or bainite phases;

b. drawing said steel wire rod directly to a steel wire with an intermediate diameter; thereby avoiding any intermediate heat treatments such as patenting;

c. providing said steel wire with a coating promoting the adhesion with elastomer products;

d. further drawing said coated steel wire to a steel filament with a final diameter below 0.60 mm and to a tensile strength exceeding 1200 MPa.

7. A method of manufacturing a steel cord adapted for the reinforcement of elastomer products, said method comprising the following steps:

a. manufacturing a steel filament according to claim 6;

b. twisting one or more of such steel filaments into a steel cord.

8. An elastomer or thermoplastic product comprising one or more filaments according to claim 1.

9. An elastomer product according to claim 8, wherein said elastomer product is a tire.

10. A thermoplastic product according to claim 8, wherein said product is an impact beam.

11. An elastomer product comprising a steel filament according to claim 1.

12. An elastomer product comprising a steel cord according to claim 4.

13. A steel filament according to claim 1, wherein said steel filament has a plain carbon composition comprising a carbon content ranging between 0.04 and 0.08 percent by weight, a silicon content of 0.166 percent by weight, a chromium content of 0.042 percent by weight, a copper content of 0.173 percent by weight, a manganese content of 0.382 percent by weight, a molybdenum content of 0.013 percent by weight, a nitrogen content of 0.006 percent by weight, a nickel content of 0.077 percent by weight, a phosphorous content of 0.007 percent by weight, and a sulfur content of 0.013 percent by weight.

14. A steel filament according to claim 13, wherein the carbon content of said plain carbon composition is 0.06 percent by weight.

* * * * *